United States Patent [19]

O'Beirne-Ranelagh

[11] 4,102,480

[45] Jul. 25, 1978

[54] THIMBLES

[76] Inventor: Bawn O'Beirne-Ranelagh, 31 Clanricarde Gardens, London W2, England

[21] Appl. No.: 725,113

[22] Filed: Sep. 20, 1976

[30] Foreign Application Priority Data

Sep. 24, 1975 [GB] United Kingdom ..... 39137/75

[51] Int. Cl.[2] ..... A41H 31/00

[52] U.S. Cl. ..... 223/101

[58] Field of Search ..... 223/101; 2/20, 21; 294/25

[56] References Cited

U.S. PATENT DOCUMENTS

| | | | |
|---|---|---|---|
| 72,751 | 12/1867 | Niles | 223/101 |
| 109,429 | 11/1870 | Law | 223/101 |
| 843,819 | 2/1907 | Huntley | 2/21 |
| 1,484,489 | 2/1924 | Givens | 2/21 X |
| 2,179,046 | 11/1939 | Lewis | 2/21 |
| 3,191,824 | 6/1965 | Burr | 223/101 |

FOREIGN PATENT DOCUMENTS

| | | | |
|---|---|---|---|
| 532,263 | 8/1931 | Fed. Rep. of Germany | 2/21 |
| 239,937 | 3/1946 | Switzerland | 223/101 |

*Primary Examiner*—George H. Krizmanich
*Attorney, Agent, or Firm*—Cooper, Dunham, Clark, Griffin & Moran

[57] ABSTRACT

A finger guard formed with a ring-like portion capable of gripping the finger on which the guard is to be placed adjacent the end of the finger and an elongated protective portion joined to the gripping portion along an arcuate section of the latter of substantially less than 90°. The protective portion extends from the gripping portion in a spiral toward the end of the finger.

7 Claims, 5 Drawing Figures

THIMBLES

This invention relates to finger guards, for example thimbles.

A conventional thimble tends to provide an unstable pushing surface for a needle and also sweating of the end of the finger on which the thimble is placed.

A so-called professional thimble has an open end instead of the closed end of the conventional thimble, but like the conventional thimble it still surrounds the whole of the finger.

According to the invention a finger guard comprises a first portion capable of gripping the finger on which the guard is to be placed adjacent the end of the finger, and an elongated protective portion joined to the gripping portion, said protective portion extending from said gripping portion towards the end of the finger in a direction inclined to the length of the finger to lie along the inside of the finger, and then back against the outside of the finger.

The finger guard may comprise a thimble or any other type of finger protective element.

Preferably the protective portion is also capable of gripping the end of the finger. In this case the gripping effect of the protective portion is preferably adjustable separately from said gripping portion of the finger guard.

In one embodiment of the invention the protective portion has a flattened part capable of covering at least part of the inside of the end of the finger onto which the finger guard is to be placed. Said extension may have a portion covering at least a part of the inside of the end of the finger, which portion has a slight concavity with respect to the surface of the finger which it covers.

Preferably the protective portion is adapted to extend over the end of the finger towards one edge thereby avoiding passing over the end of the nail.

It is also preferred that the protective portion is narrower throughout its length than the finger on to which the finger guard is to be placed.

Preferably the edges of the part of the protective portion which extends along the inside of the finger are convergent in the direction towards the gripping portion of the finger guard.

Also the part of the protective portion which lies against the outside of the finger is preferably unattached to the gripping portion of the finger guard.

The gripping portion may comprise a split ring which partially surrounds the finger. In one embodiment of the invention the protective portion comprises an integral extension of one end of the split ring. Also, in use, preferably both ends of the split ring overlie the inside of the finger.

At least a part of the protective portion may have a roughened external surface, e.g. formed by dimpling.

In one embodiment of the invention at least a part of the gripping portion and/or the protective portion has an edge or rim which is turned over away from the finger to provide a smooth edge for engagement with the finger.

The finger guard may be formed of metal, e.g. formed from sheet metal. Alternatively, the finger guard may be moulded in a suitable plastics material, e.g. reinforced glass fibre or suitably rigid polyethylene or polystyrene.

By way of example, specific embodiments in accordance with the invention will be described with reference to the accompanying drawings in which.

Figure 1:
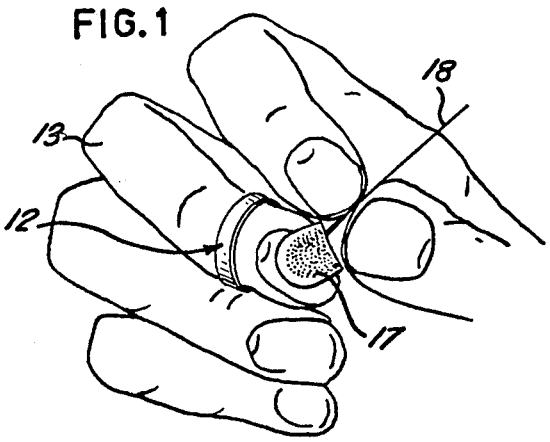
FIG. 1 shows a thimble placed on the middle finger of a user's right hand.
Figure 3:
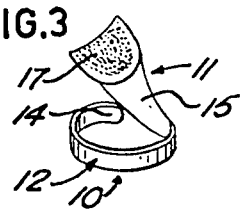
FIG. 3 is a perspective view of the thimble of FIG. 1 off the finger.
Figure 2:
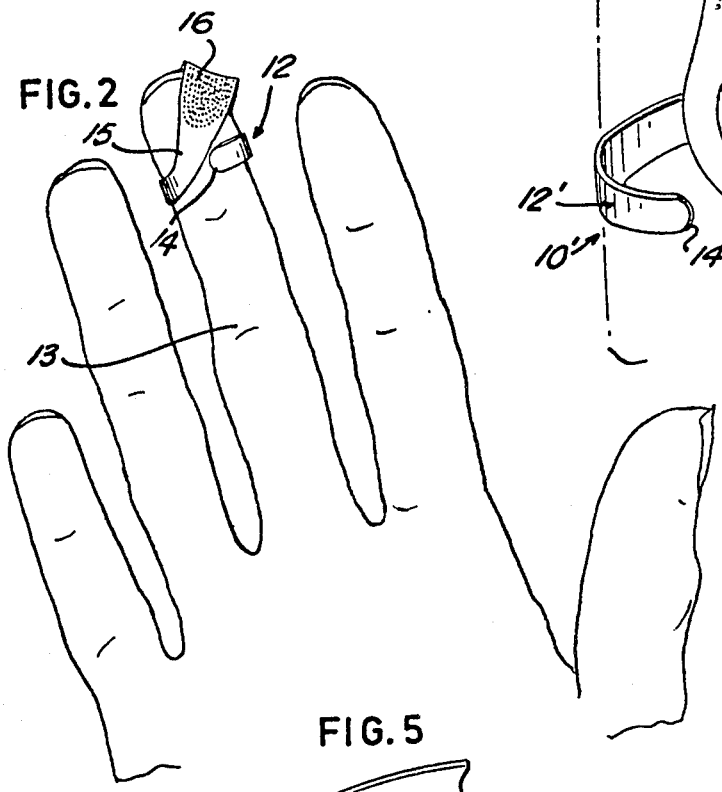
FIG. 2 shows the thimble of FIG. 1 as viewed from the inside of the user's right hand.

Referring to FIGS. 1 to 3, a thimble is formed from a sheet metal blank to provide a gripping portion 10 and a protective portion 11. The gripping portion 10 comprises a split ring 12 which, in use, partially surrounds, for example, the middle finger 13 of the right hand of the user adjacent the end of the finger. In this embodiment, the split in the ring 12 is positioned on the inside of the finger 13 (see FIG. 3), but it may be positioned at any other desired location around the finger. The free end 14 of the ring 12 may be bent inwardly or outwardly with respect to the finger 13 to allow for the required adjustment of the gripping effect of the ring on the finger.

The protective portion 11, in this embodiment, is integral with the ring 12 and comprises an extension 15 from the ring which extends towards the end of the finger 13 but is inclined to the length of the finger. The extension 15 thereby provides an operative part 16 which covers a desired area of the finger adjacent its end which, in this embodiment, is the right hand portion of the inside of the finger. The extension 15 also extends over the end of the finger towards one edge so that it does not pass over the end of the nail, and then back against the outside of the finger (see FIG. 1) partially covering the nail. The particular location selected in this embodiment at which the extension 15 passes over the end of the finger is especially advantageous if the nail of the finger is longer than the finger itself.

At least the operative part 16 and in this embodiment the nail covering part 17 also has a roughened external surface, for example formed by dimpling, to provide a non-slip pushing surface for a needle. The operative part 16 may be shaped so that it is outwardly convex or, as in this embodiment, it may be flattened with a slight concavity with respect to the finger to assist in the provision of a stable pushing surface for a needle 18.

The nail covering part 17 may also be of any required shape and in this embodiment is flattened with respect to the end of the finger in like manner to the operative part 16. Such flattening of the part 17 reduces any tendency for the thimble to turn around the finger. Also a user may wish to use the part 17 as a pushing surface for the needle 18 in which case the flattening assists in the provision of a stable pushing surface.

Figure 4:
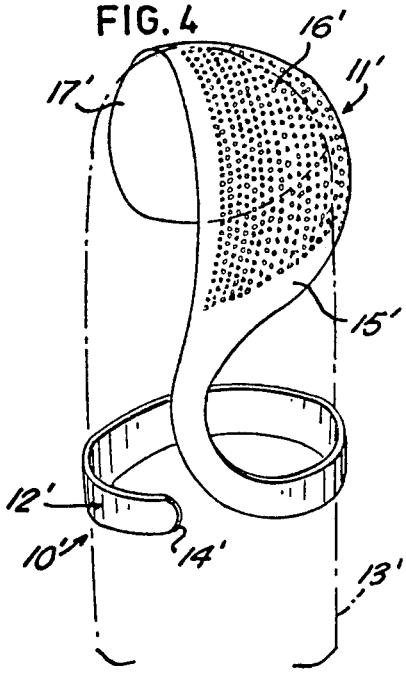
FIG. 4 is a perspective view of another thimble placed on a finger which is shown in dash-dot lines.

FIG. 4 shows a thimble which is substantially the same as the thimble shown in FIGS. 1 to 3 except that the shape of the protective portion is changed. In this case the operative part 16' covers a greater portion of the inside of the finger and the protective portion extends more directly over the end of the finger 13' instead of towards one edge of the finger.

Figure 5:
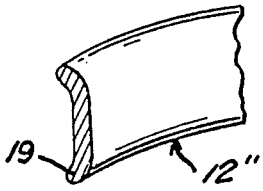
FIG. 5 shows part of a modified thimble.

FIG. 5 shows part of a modified thimble in which the edges of the thimble are turned outwardly with respect to the finger to provide a rim 19 and thereby a smooth edge for engagement with the finger. The rim 19 avoids any tendency for the thimble to cut into the finger and inhibits any tendency there may be for the cotton being sewn to pass between the thimble and the finger.

In a modified embodiment (not shown) the protective portion extends around an edge of the finger to lie back against the outside of the finger without passing over the end of the finger.

Each of the embodiments described above is designed particularly for the middle finger of the user's right hand. However, the shape of each embodiment of thimble may be readily altered so that it is a mirror image of the shape shown in the drawings and thereby suitable for the middle finger of the user's left hand. In fact both a left-handed and a right-handed thimble may be formed from the same sheet metal blank.

It is mentioned above that the split ring 12 of the embodiment of FIGS. 1 to 3 is adjustable to the size of the user's finger. The same applies to the split rings of the embodiments of FIGS. 4 and 5. Similarly, in the case of each embodiment, further adjustment of the shape of the thimble may be made by the user altering the shape of the protective portion of the thimble. For example, the user may alter the relative positions of the operative part of the thimble relative to the nail covering part and/or the split ring of the thimble. The thimble may thus be readily adapted for use on another finger, e.g. the index finger. Similarly the thimble is readily adaptable for use by other persons.

The invention is not restricted to the specific details of the embodiments described above. For example, the gripping portion of each thimble may comprise a band or coil instead of a split ring. The band may be a closed band or one which extends only partially around the finger. In the case of a coil it may extend more than once, for example, twice around the finger.

Also, each form of thimble may be made of a suitable plastics material instead of metal. For example, the thimble may be moulded from materials such as reinforced glass fibre, polyethylene and polystyrene. Thimbles may also be provided in a wide colour range. In the case of a metal thimble any suitable metal may be selected, even precious metals such as gold and silver, or the thimble may be plated with such a metal.

Furthermore, although each embodiment has been described as a thimble, it is essentially a finger guard or a guard for a selected portion of one of the user's fingers. It will thus be appreciated that each embodiment of thimble has the additional more general use of a finger guard, e.g. for use by machine operators and like persons.

There has thus been described embodiments of a unique finger guard which includes a ring-like portion capable of gripping the finger of a user adjacent the finger's end and an elongated protective portion which preferably is joined to the ring-like portion along an arcuate section thereof of substantially less than 90°. The protective portion extends away from the ring-like portion, preferably spirally away along a helical path, terminating in a terminal portion which preferably extends back toward the ring-like portion. The guard thus covers only those required portions of the finger, permitting sufficient ventilation of other parts of the finger so as to minimize discomfort while maximizing protection.

Accordingly, the invention should be taken as defined by the following claims.

What is claimed is:

1. A finger guard comprising a first ring-like portion capable of gripping the finger on which the guard is to be placed adjacent the end of the finger, and an elongated protective portion joined to said ring-like portion along an arcuate section thereof of substantially less than 90° and extending transversely away from the plane of said ring-like portion in a helix-like path and terminating in a terminal portion remote from said ring-like portion and which extends back toward but terminates short of said ring-like portion, said elongated protective portion adapted to lie against the inside of the finger of a user and said terminal portion adapted to extend over at least a part of the fingernail of the user.

2. A finger guard according to claim 1, wherein said protective portion has a flattened part.

3. A finger guard according to claim 1, wherein said terminal portion has a slight concavity.

4. A finger guard according to claim 1, wherein said first ring-like portion is a split ring which partially surrounds the finger.

5. A finger guard according to claim 4, wherein said protective portion comprises an integral extension of one end of said split ring, said integral extension extending in generally a helical path away from said split ring end.

6. A finger guard according to claim 1, wherein at least a part of at least one of said first ring-like portion and said protective portion has an edge which is turned over away from the finger to provide a smooth edge for engagement with the finger.

7. A finger guard according to claim 1, wherein said elongated protective portion is of increasing width proceeding away from said ring-like portion toward said terminal portion.

* * * * *